US011007775B2

(12) United States Patent
Rubio et al.

(10) Patent No.: US 11,007,775 B2
(45) Date of Patent: May 18, 2021

(54) NOZZLE FIRING ORDER CONTROLLER

(71) Applicant: Hewlett-Packard Development Company, L.P., Spring, TX (US)

(72) Inventors: Leticia Rubio, Barcelona (ES); Utpal Kumar Sarkar, Barcelona (ES); Xavier Quintero Ruiz, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/475,618

(22) PCT Filed: Apr. 25, 2017

(86) PCT No.: PCT/US2017/029362
§ 371 (c)(1),
(2) Date: Jul. 2, 2019

(87) PCT Pub. No.: WO2018/199926
PCT Pub. Date: Nov. 1, 2018

(65) Prior Publication Data

US 2019/0322100 A1 Oct. 24, 2019

(51) Int. Cl.
*B41J 2/045* (2006.01)

(52) U.S. Cl.
CPC ..... *B41J 2/0451* (2013.01); *B41J 2/04586* (2013.01)

(58) Field of Classification Search
CPC .. B41J 2/0451; B41J 2/04586; B41J 2/04588; B41J 2/04553; B41J 2/04558; B41J 2/04568; B41J 2/2132; B41J 2/2139
See application file for complete search history.

(56) References Cited

U.S. PATENT DOCUMENTS

| | | | | |
|---|---|---|---|---|
| 6,659,580 | B2 | 12/2003 | Horikoshi | |
| 6,771,379 | B2 | 8/2004 | Vilanova et al. | |
| 7,604,320 | B2 | 10/2009 | Robertson et al. | |
| 7,735,948 | B2 | 6/2010 | Walmsley et al. | |
| 8,336,981 | B2 | 12/2012 | Chen et al. | |
| 2008/0266345 | A1* | 10/2008 | Onodera | B41J 2/2139 |
| 2009/0128594 | A1 | 5/2009 | Martinez et al. | |
| 2012/0287186 | A1 | 11/2012 | Tanaka et al. | |
| 2016/0288492 | A1* | 10/2016 | Isal Cortes et al. | B41J 2/16579 |

OTHER PUBLICATIONS

Colburn, W. S., et al., Automated Assembly and Testing of HP DeskJet 1200C Print Cartridges, Feb. 1994, < http://www.hpl.hp.com/hpjournal/94feb/feb94a11.pdf >.

* cited by examiner

*Primary Examiner* — Jason S Uhlenhake
(74) *Attorney, Agent, or Firm* — HP Inc. Patent Department

(57) ABSTRACT

A circuit 108 for controlling a plurality of fluid dispense nozzles 202(N), the circuit 108 to change an order in which the fluid dispense nozzles 202(N) are actuated.

17 Claims, 3 Drawing Sheets

| Nozzle ID | Health Status |
|---|---|
| 0 | None |
| 1 | C |
| 2 | D |
| 3 | None |
| 4 | None |
| 5 | A |
| 6 | D |
| 7 | C |
| 8 | A |
| 9 | None |
| 10 | None |
| 11 | None |

Fig. 4

| Nozzle ID | Health Status | Replacing Nozzle |
|---|---|---|
| 0 | None | 0 |
| 1 | C | 0 |
| 2 | D | 3 |
| 3 | None | 3 |
| 4 | None | 4 |
| 5 | A | 5 |
| 6 | D | 5 |
| 7 | C | 8 |
| 8 | None | 8 |
| 9 | None | 9 |
| 10 | A | 9 |
| 11 | None | 10 |

Fig. 5

| Firing Order |
|---|
| 4 |
| 5 |
| 5 |
| 3 |
| 3 |
| 0 |
| 0 |
| 8 |
| 9 |
| 8 |
| 9 |
| 10 |

Fig. 6

NOZZLE FIRING ORDER CONTROLLER

BACKGROUND

To maintain print quality (PC)) of printed output from a printer, the print nozzles from which print fluid is dispensed are monitored to determine their print fluid dispense performance, also referred to as "nozzle health". Depending on a nozzle's performance it may be actuated, also referred to as "fired", in a manner to improve or rectify poor or sub-operational performance and also to avoid the use of nozzles determined as being non-operational, also referred to as "dead nozzles". The improvement or rectification of the dispense performance of a nozzle or the avoidance of the use of a nozzle is to be achieved without missing content in the printed output and minimising detriment to the print quality.

BRIEF DESCRIPTION OF THE DRAWINGS

The following description is provided by way of example and with reference to the accompanying drawings, in which:

FIG. 4 shows an example table for a trench that may be stored in a nozzle health database;

FIG. 5 shows an example firing order table that may be derived based on the example table of FIG. 4;

FIG. 6 shows another example firing order table.

DESCRIPTION

Figure 1:
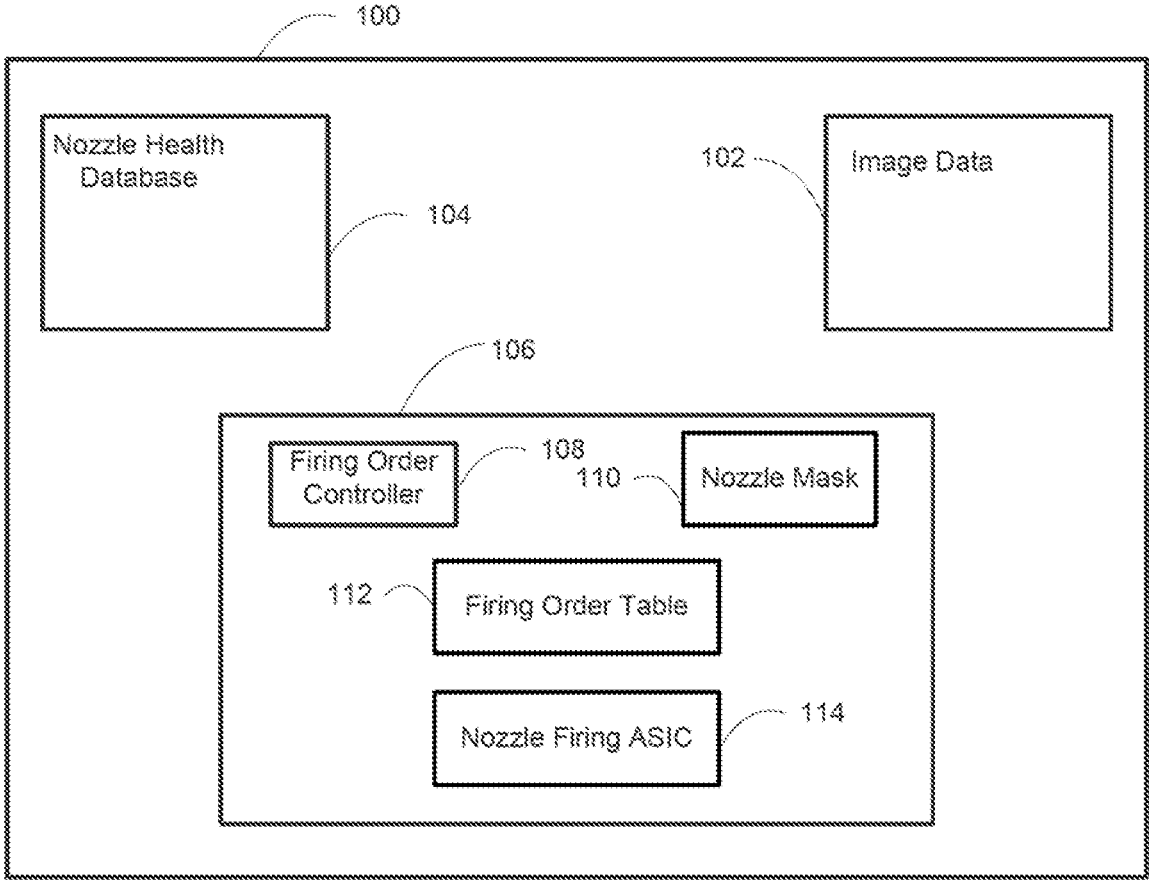
FIG. 1 is a schematic illustration of a printer with a nozzle firing order controller in accordance with an example of the present disclosure.

Referring to FIG. 1, a printer 100 comprises a store of image data 102 in which a digital representation of the image to be printed is stored. The image data store 102 also comprises masks for respective colours to dispense a combination of print fluid from the printer on to a page being printed to achieve a colour or corresponding to the part of the image being printed. For a black and white mode of printing or a grayscale print the mask may be a simple binary mask representative of dispensing or non-dispensing of a black print fluid.

Printer 100 also comprises a nozzle health database 104. Nozzle health may be determined in the present example by drop detection measurement. The health of a nozzle may be categorised as simply good or bad meaning that a good nozzle may be used and use of a bad nozzle should be avoided. Intermediate performance categories may also be determined for a nozzle depending on measured drop characteristics, for example drop size.

An example of nozzle actuation management circuitry 106 in accordance with the disclosure is illustrated collectively in the described example and includes a nozzle firing order controller 108, a nozzle mask 110, a firing order table 112 and nozzle firing Application Specific Integrated Circuit (ASIC) 114 which produces nozzle actuation electrical signals in the order defined in the firing order table 112 and provides the actuation signals to nozzles to cause them to fire. The nozzle firing order controller 108 circuit may control nozzles to change an order in which the nozzles are actuated from firing event to firing event. The nozzle firing order controller 108 circuit may control nozzles to actuate a nozzle of the plurality of fluid dispense nozzles more than once in a pass.

Figure 2:
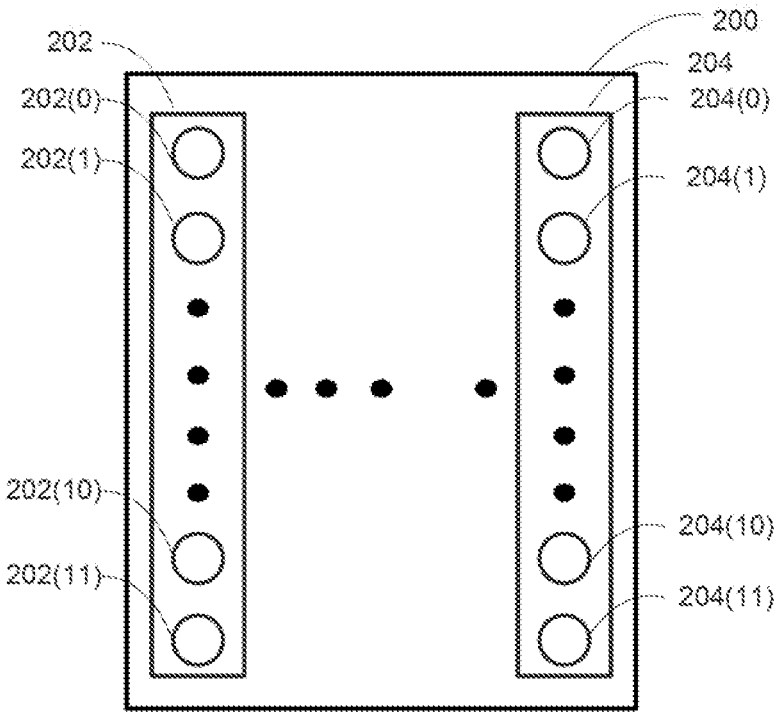
FIG. 2 is a schematic illustration of an example of a print carriage and a nozzle trenches in accordance with the present disclosure.

FIG. 2 is a schematic illustration of an example of a print head carriage 200 housing a number of nozzle trenches 202 . . . 204. Each nozzle trench 202, 204 has 12 nozzles: 202(0), 202(1) . . . 202(10), 202(11); and 204(0), 204(1) . . . 204(10), 204(11). Electrical firing signals are supplied from nozzle firing ASIC 114 to respective nozzles in each nozzle trench 202 . . . 204 which are to fire. The number of trenches may vary from print head to print head depending upon implementation detail and design criteria. In FIG. 2, the dots between respective illustrated nozzle trenches 202 and 204 are intended to indicate that further trenches may be included between the illustrated trenches. Likewise, the dots between the illustrated nozzles are intended to indicate the presence of nozzles (2) through to (9).

In the process for printing an image, the print head carriage 200 is passed relative to the medium upon which the printing takes place. In the described example, the printing medium is moved in a first direction relative to the print carriage and the print carriage moves in a second direction perpendicular to the first direction. The described example is a multi-pass printer having two passes. That is to say, the print head carriage 200 moves in the second direction two times for the same part of the image to be printed. A different set of nozzles in each trench is used per parts. For example, in a two pass scanning printer half of the nozzles are used on the first pass and therefore half the density of printing takes place. In the second pass the media, or build material, on which the printing is taking place is advanced in the second direction a distance corresponding to the nozzles already used and the remaining half of the nozzles are used.

A trench comprising nozzles may be used for a particular function, for example to print a specific colour or even to print a fixing fluid. Depending upon whether or not a trench is to be used in a particular pass, for example what colour is to be printed or whether or not a fixing fluid is to be applied, a mask is applied over the trench which will mask off the nozzles of a trench which is not to used. Additionally, in any particular pass half the nozzles of a trench will be used and so those nozzles not being used will be masked.

Nozzle mask 110 is a binary mask representing firing/not firing of each nozzle of the trench and each column of the image for printing the image. Nozzle mask 110 controls nozzle firing ASIC 114 which outputs electrical signals to the nozzles to cause them to fire. In the example in accordance with the present disclosure, firing order controller 108 utilises data in the nozzle health database 104 to determine which nozzles of the trench to be used in the current pass as indicated in the nozzle mask are to be utilised and in what order. The determination of nozzle order made by firing order controller 108 creates a firing order table 112. Thus, even though the nozzle mask 110 may indicate that a nozzle is to fire in a pass if that nozzle is dead or has some other status that means the firing order controller 108 has determined it is not to be used the firing order table will control fire signals to fire a replacement nozzle. In the example illustrated in FIG. 2, nozzles (0) through to (5) are applied in the first pass and nozzles (6) through to (11) are applied in the second pass.

In the example in accordance with the present disclosure a different firing order table 112 is generated in, real time for each trench and pass according to nozzle health information stored in the nozzle health database 104.

The firing order table 112 will be the same during the process of printing a job for respective trench 202/204 unless a drop detection occurs during the printing process which indicates a change in the health of the nozzle in a trench. If drop detection occurs the nozzle health information is updated in the nozzle data base 104 with the drop detection sensor data during the printing process. Any change in the health of a nozzle will be automatically included in the nozzle health database 104 by way of the updating of drop detection sensor which will incorporate the most recent measurement. If drop detection occurs or is initiated by the printer 100 or print head 200 the firing order controller 108 re-computes the firing order tables 112 and the binary nozzle mask 110 is regenerated. Drop detection may not be launched while printing and consequently the binary mask generated from the firing order table 112, and each firing order table 112 itself, for each trench to be generated just once before the start of the printing process.

Figure 3:
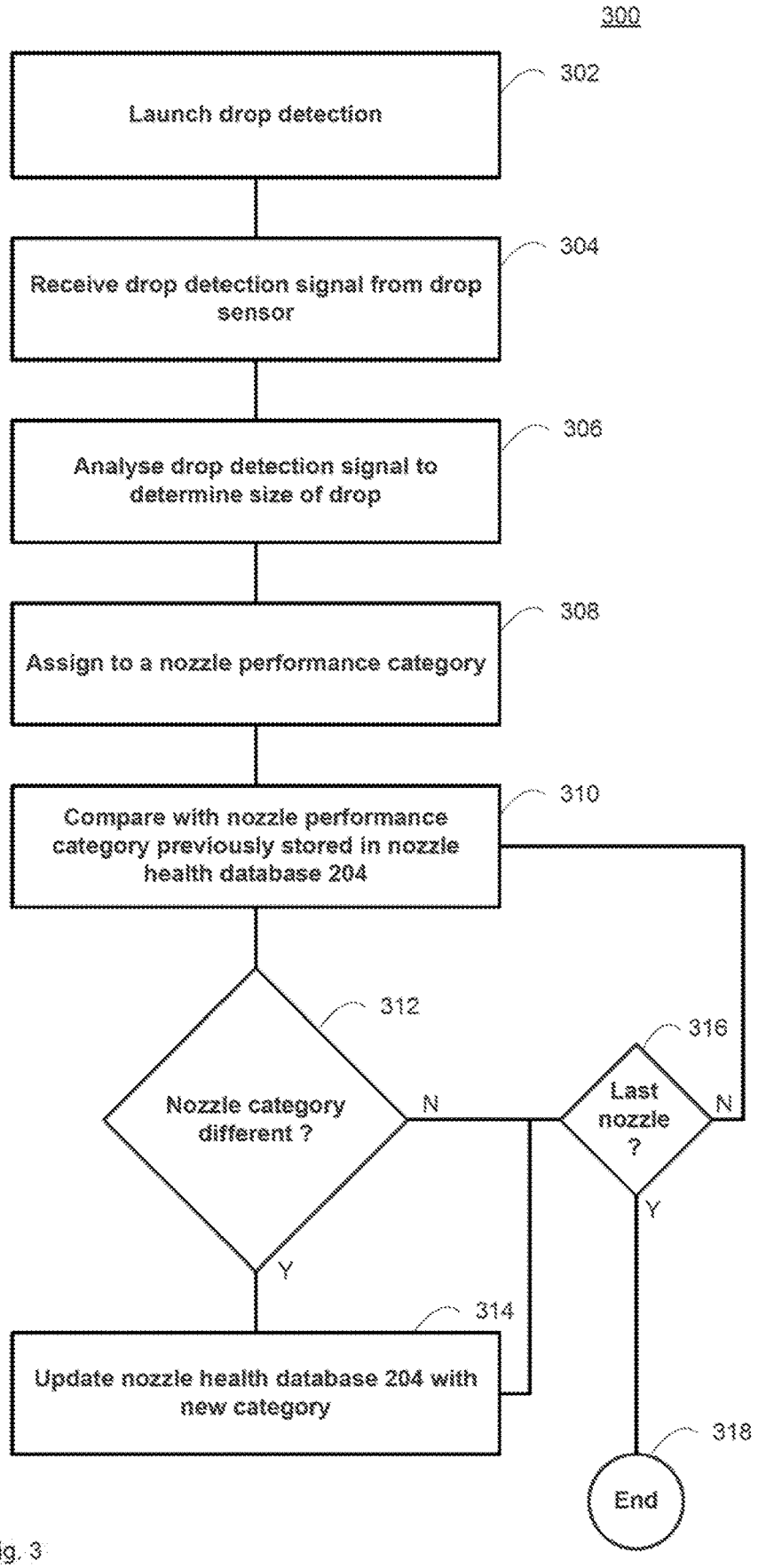
FIG. 3, illustrates a process flow control diagram setting out the procedure for populating a nozzle health database for an example in accordance with the present disclosure.

In the described example, firing order controller 108 is implemented by way of programmable microprocessor circuitry in accordance with machine-readable instructions provided thereto. Firing order controller 108 may be implemented as part of machine-readable instructions for implementing firing order management circuitry 106 and all the nozzle health database 104 and the management and analysis of image data 102. Turning now to FIG. 3, a process flow control diagram is illustrated setting out the procedure for populating the nozzle health database 104.

Turning now to FIG. 3 there is illustrated a process flow control diagram 300 for the population of the nozzle health database 104 for the present example. At phase 302, drop detection is launched. Drop detection is initiated and the signal is received at the firing order controller 108 from the sensor or drop detector, phase 304. The signal from the sensor or drop detector is representative of the size of the drop. The signal received from the sensor or drop detector is processed and analysed in the firing order controller 108 to determine drop size at phase 306.

Process flow control proceeds to phase 308 in which the drop, size is evaluated and assigned to a nozzle performance category. The nozzle performance category may comprise a hierarchy of performance status indicating different levels of health severity and running from a performance category in which there is no nozzle health issue to a performance category in which the nozzle may be considered unusable and therefore "dead". Where there is no nozzle health performance issue, the status may simply be considered as "use" whereas were nozzle is considered to be completely dead the status may simply be considered as "do not use". The intermediate categories between "use" and "do not use" status indicate sub-operational performance which may mean that the nozzle can be used or not used depending upon the circumstances. In the example in accordance with the described disclosure the following categories may be established and a nozzle performance assigned to a respective category in phase 308.

The respective nozzle performance categories for the example described accordance with the present disclosure are set out below:

"None"—indicates that no health issue was identified for the nozzle;

"A"—Failing (contradictory information from drop detector in the last runs);

"B"—Possibly dead (non-consecutive drop detections have given some signals warning a possible problem);

"C"—Almost dead (not firing in most of the last n drop detections);

"D"—Completely dead (not firing in the last n drop detections).

At phase 310, the nozzle performance category assigned to the signal received from the drop detector is compared with a stored nozzle performance category for the nozzle under analysis. If the nozzle performance category is different from that previously stored, phase 312, process control flows to phase 314 at which the nozzle health database 104 is updated with the new performance category the nozzle under analysis. If the nozzle category is not different process control flows to decision phase 316 where it s determined whether or not the nozzle under analysis is the last nozzle that is to be analysed. If these not the last nozzle to be analysed process control flows back to phase 310 where the nozzle performance category for the next nozzle in the analysis sequence is compared with the nozzle performance category stored in the nozzle health database 104 for that next nozzle. Otherwise, if it is determined at phase 316 that the last nozzle has been analysed then process control flows to the endpoint 318.

An example of a table for a trench 202 that may be stored in nozzle health database 104 as illustrated in FIG. 4. The nozzle identity is set out in a first column and the health status is set out in the second column. An example of the firing order controller 108 in accordance with the described disclosure utilises directly the low level information of nozzle status provided by the nozzle health database 104 to determine a firing order for nozzle usage.

An example of the operation of the firing order controller 108 in accordance with the present disclosure will now be described with reference to FIG. 5 which illustrates a firing order table that has may be derived for nozzle trench 202 based upon the nozzle table stored in nozzle health database 104 four trench 202 and illustrated in FIG. 4.

In the described example the nozzle health table illustrated in FIG. 4 indicates the following usage cases and decision trees executed by the firing order controller 108 under control of machine-readable instructions.

Nozzle 0 will not be replaced.

Nozzle 1 having status C, may be replaced with nozzle 0, due to nozzle 2 being dead. Thus, nozzle 0 will fire for respective pixels, its own and for the pixel for which it is replacing nozzle 1. Respective firing of nozzle 0 will take place in two different firing events—the firing event in which nozzle 0 would normally fire and the firing event for nozzle 1.

Nozzle 2 is dead, so nozzle 3 is to replace nozzle 2.

Nozzles 3 and 4 are alive. Nothing special is to be done with them. Just use them to fire if they are to do it.

Nozzle status for nozzle 5 is A. This nozzle performance status is in a sub-operational performance category and at a relatively high end of the nozzle performance category hierarchy. Consequently, although it may have a sub-operational performance it may nevertheless be usable. Thus, it may be used or replaced by nozzle 4. The performance category status of adjacent nozzle 6 is a Nozzle 6 can be recovered by 5 or 7, but 7 is almost dead. Nozzle 5 is assigned to be used twice as multiple firing of a nozzle may improve its performance as it can cause dislodging of any contaminant or system self-correction of the nozzle. Thus, the firing order controller 108 populates the firing order table 112 so that nozzle 5 will fire in its usual position and also when nozzle 6 has to fire to replace nozzle 6.

The decision tree for nozzle 5 provides for a branch in which nozzle, due to its relatively high place in the performance category hierarchy, may be used and is used twice so that it not only replaces an adjacent nozzle is also fired for its own location for nozzle maintenance purposes.

Nozzle 8 is used instead of 7, whose status is C and too low in the nozzle performance category hierarchy attempt to be made to fire it to attempt a self-correction.

The group of nozzles 9, 10 and 11 may be considered together and firing order controller 108 populates the firing order table 112 to replace nozzle 10 with nozzle 9 because nozzle 10 is towards an end of the trench and nozzle quality may deteriorate the closer to an end of a trench a nozzle is located. Consequently, firing order controller 108 populates firing order table 112 so that nozzle 9 fires for its own location and also to replace nozzle 10. Nozzle 11 is replaced by the nozzles in the middle of a trench first in order to warm the nozzles at the ends nozzle 10 because although nozzle 10 has a lower performance than nozzle 11, nozzle 11 is at the extreme end of the trench and therefore may have a lower quality output than nozzle 10 even though nozzle 10 is in a lower performance category than nozzle 11. Making nozzles fire more often than expected or designed for may contribute to an increase in temperature, making the printing fluid more liquid and therefore have a bigger drop in the media once fired. Using trenches in the middle to increase performance of nozzles in the border is an example of an application of the heating effect and this also may be applied to a single nozzle itself.

In an example of the firing order controller 108 in accordance with the present disclosure, the firing order controller 108 may execute machine-readable instructions to use of the trench. The nozzles that are at the end of the trench may be colder than those towards the middle and dispense a smaller drop weight or size of printing fluid and thus provide less coverage and worse print quality than the nozzles towards the middle the trench IQ.

FIG. 6 illustrates a table comprising a firing order table 112 defined as a 1-column table with as many rows as nozzles in the trench being used, in the present example. The number in each respective row determines which nozzle will be actuated to fire and therefore the order in which the nozzles will receive the electrical pulses that make them fire or not at a given position.

The table illustrated in FIG. 6 is entitled "firing order" because it is indicative of the order in which nozzles of trench 102 will be activated. The position of each nozzle entry in the table illustrated in FIG. 6 determines when nozzle is actuated to be fired. However, in an example of a firing order controller 108 in accordance with the present disclosure nozzles may not be actuated or fired in real time in the order set out the table of FIG. 6. Actuation of a print head may be in response to a number of firing events in which groups of nozzles would be actuated to fire according to the relevant binary mask. Amongst other things, utilising a plurality of firing events separates the firing of closely adjacent nozzles in a trench and therefore may ameliorate the possibility of their being insufficient printing fluid for the firing of a nozzle.

In one example there may be 8 possible firing event timings such that the sequence is 0,1,2,3,4,5,6,7,0,1,2,3,4, 5,6,7,0,1,2,3 . . . and so on. Thus, in the example firing order table illustrated in FIG. 6 at the first firing event pulse nozzle 4 and 9 would fire, then 5 and 8, then 5 and 9, then 3 and 10, then 3, then 0, then 0 and finally 8.

Insofar as the disclosure described above is implementable, at least in part, using a machine readable instruction-controlled programmable processing device such as a general purpose processor or special-purposes processor, digital signal processor, microprocessor, or other processing device, data processing apparatus or computer system it will be appreciated that a computer program for configuring a programmable device, apparatus or system to implement the foregoing described methods, apparatus and system is envisaged as an aspect of the present disclosure and claimed subject matter. The computer program may be embodied as any suitable type of code, such as source code, object code, compiled code, interpreted code, executable code, static code, and or dynamic code, for example. The instructions may be implemented using any suitable high-level, low-level, object-oriented, visual, compiled and/or interpreted programming language, such as C, C++, Java, BASIC, Perl, Matlab, Pascal, Visual BASIC, JAVA, ActiveX, assembly language, machine code, and so forth. The term "computer" in its most general sense may encompass programmable devices such as referred to above, and data processing apparatus and computer systems in whatever format they may arise, for example, desktop personal computer, laptop personal computer, tablet, smart phone or other computing device.

The computer program may be stored on a computer readable storage medium in machine readable form, for example the computer readable storage medium may comprise memory, removable or non-removable media, erasable or non-erasable media, writeable or re-writeable media, digital or analog media, hard disk, floppy disk, Compact Disk Read Only Memory (CD-ROM), Compact Disk Recordable (CD-R), Compact Disk Rewriteable (CD-RW), optical disk, magnetic media, magneto-optical media, removable memory cards or disks, various types of Digital Versatile Disk (DVD) subscriber identity module, tape, cassette solid-state memory. The computer program may be supplied from a remote source and embodied in a communications medium such as an electronic signal, radio frequency carrier wave or optical carrier waves. Such carrier media are also envisaged as aspects of the present disclosure.

As used herein any reference to "one disclosure" or "a disclosure" means that a particular element, feature, structure, or characteristic described in connection with the disclosure is included in at least one disclosure. The appearances of the phrase "in one disclosure" or the phrase "in an disclosure" in various places in the specification are not necessarily all referring to the same disclosure.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false for not present) and B is true (or present), and both A and B are true (or present).

In addition, use of the "a" or "an" are employed to describe elements and components of the disclosure. This is done merely for convenience and to give a general sense of the disclosure. This description should be read to include one or at least one and the singular also includes the plural unless it is obvious that it is meant otherwise.

Various modifications may be made within the scope of the disclosure. Although examples of the disclosure has been described using a printer, the disclosure is not limited to use with printers but may be implemented in other devices in which fluid is dispensed through a plurality of proximally located fluid dispense nozzles. The nozzle health database may be located remote from the printer, so to the image data store or a part thereof.

Drop detection and measurement may be achieved using a method other than that referred to in the described example and examples in accordance with the disclosure include printers other than ink jet printers that dispense print fluid through a plurality of proximally disposed nozzles and where print fluid dispense performance of a nozzle may be measured. Drop detection and measurement for the example described herein refers to drop size but other characteristics of a drop may be used instead or in addition to drop size. Although an example of the disclosure has been described in which nozzle health information was updated during a printing process, this feature may not be activated in production print-modes.

Although the disclosure has been described with reference to a programmable integrated circuit such as a microprocessor other programmable devices such as referred to above may be used. Firing order controller 108, and or other elements of the firing order management circuitry alone or in combination, may be implemented in hardware using discrete circuitry or machine-readable instructions or a combination thereof.

The size of the firing order table 112 in terms of the number of rows may not match exactly the number of nozzles in the trenches. A table corresponding to a single trench can be separated into tables of lesser size and applied periodically to the rest of the nozzles of the trench.

The scope of the present disclosure includes any novel feature or combination of features disclosed therein either explicitly or implicitly or any generalisation thereof irrespective of whether or not it relates to the claimed subject matter or mitigates against any or all of the issues addressed by the present disclosure. The applicant hereby gives notice that new claims may be formulated to such features during prosecution of this application or of any such further application derived therefrom. In particular, with reference to the appended claims, features from dependent claims may be combined with those of the independent claims and features from respective independent claims may be combined in any appropriate manner and not merely in specific combinations enumerated in the claims.

The invention claimed is:

1. A circuit for controlling a plurality of fluid dispense nozzles, the circuit to change an order in which the fluid dispense nozzles are actuated on a per-nozzle basis, in dependence on a nozzle performance status for a nozzle of the plurality of fluid dispense nozzles, wherein the nozzle performance status is of a hierarchy of performance status comprising use performance status, do not use performance status, and a sub-operational status interposed between the use performance status and the do not use performance status.

2. The circuit according to claim 1, the circuit to inspect a store of the nozzle performance status for the nozzle of the plurality of fluid dispense nozzles.

3. The circuit according to claim 1, the circuit to change the order in which the plurality of fluid dispense nozzles are actuated in dependence on respective nozzle performance for a multiplicity of the plurality of fluid dispense nozzles.

4. The circuit according to claim 3, the circuit to inspect a store of the nozzle performance status for the multiplicity of the plurality of fluid dispense nozzles.

5. The circuit according to claim 1, the circuit to actuate the nozzle comprising the sub-operational performance status to replace actuation of an adjacent nozzle to the nozzle responsive to the adjacent nozzle comprising a performance status lower in the hierarchy of performance status than the performance status of the nozzle.

6. The circuit according to claim 5, the circuit to actuate the nozzle comprising the sub-operational performance status to replace actuation of the adjacent nozzle responsive to the nozzle being adjacent a second adjacent nozzle the second adjacent nozzle to another side of the nozzle relative to the adjacent nozzle, the second adjacent nozzle comprising a performance status higher in the hierarchy of performance status than the nozzle.

7. The circuit according to claim 6, the circuit to actuate the second adjacent nozzle and to actuate the nozzle to replace the adjacent nozzle in a same pass.

8. The circuit according to claim 1, the circuit to actuate a fluid dispense nozzle of the plurality of fluid dispense nozzles more than once in a pass.

9. A printer comprising the circuit according to claim 1, wherein the plurality of fluid dispense nozzles comprises print fluid dispense nozzles.

10. A processor, comprising processor executable instructions to implement the circuit according to claim 1.

11. A method for operating a plurality of fluid dispense nozzles, the method comprising changing an order in which the fluid dispense nozzles are actuated on a per-nozzle basis, in dependence on a nozzle performance status for a nozzle of the plurality of fluid dispense nozzles, wherein the nozzle performance status is of a hierarchy of performance status comprising use performance status, do not use performance status, and a sub-operational status interposed between the use performance status and the do not use performance status.

12. The method according to claim 11, further comprising changing the order in which the plurality of fluid dispense nozzles are actuated in dependence on respective nozzle performance for a multiplicity of the plurality of fluid dispense nozzles.

13. The method according to claim 11, further comprising actuating the nozzle comprising the sub-operational performance status to replace actuation of an adjacent nozzle to the nozzle responsive to the adjacent nozzle comprising a performance status lower in the hierarchy of performance status than the performance status of the nozzle.

14. The method according to claim 13, further comprising actuating the nozzle for the nozzle being adjacent a second adjacent nozzle to another side of the nozzle relative to the adjacent nozzle, the second adjacent nozzle comprising a performance status higher in the hierarchy of performance status than the nozzle.

15. The method according to claim 14, further comprising actuating the second adjacent nozzle and actuating the nozzle to replace the adjacent nozzle in a same pass.

16. The method according to claim 11, further comprising actuating a fluid dispense nozzle of the plurality of fluid dispense nozzles more than once in a pass.

17. A machine readable medium, comprising processor executable instructions executable by a processor to implement a method according to claim 11.

* * * * *